United States Patent [19]

Knop

[11] Patent Number: 4,924,802

[45] Date of Patent: May 15, 1990

[54] COATER FOR COATING MATERIAL WEBS

[75] Inventor: Reinhard Knop, Bochum, Fed. Rep. of Germany

[73] Assignee: Jagenberg Aktiengesellschaft, Dusseldorf, Fed. Rep. of Germany

[21] Appl. No.: 238,012

[22] Filed: Aug. 29, 1988

Related U.S. Application Data

[63] Continuation-in-part of Ser. No. 17,190, Feb. 20, 1987.

[30] Foreign Application Priority Data

Feb. 21, 1986 [DE] Fed. Rep. of Germany ..... 3605613

[51] Int. Cl.[5] ..... B05C 1/04

[52] U.S. Cl. ..... 118/410

[58] Field of Search ..... 118/407, 410, 413, 419

[56] References Cited

U.S. PATENT DOCUMENTS

| | | | |
|---|---|---|---|
| 3,030,917 | 4/1962 | Brown et al. | 118/413 |
| 3,032,007 | 5/1962 | McCauliff | 118/407 |
| 3,252,443 | 5/1966 | Growdon et al. | 118/407 |
| 3,253,443 | 5/1966 | Growdon et al. | 118/407 |
| 3,326,123 | 6/1967 | Smalley | 101/366 |
| 4,023,487 | 5/1977 | Mitter | 101/366 |
| 4,133,293 | 1/1979 | Smejda | 118/413 |
| 4,398,494 | 8/1983 | Alheid | 118/413 X |
| 4,513,662 | 4/1985 | Schneider | 118/407 |

FOREIGN PATENT DOCUMENTS

| | | | |
|---|---|---|---|
| 3300612 | 8/1983 | Fed. Rep. of Germany . | |
| 1167512 | 4/1958 | France | 118/407 |

*Primary Examiner*—Willard Hoag

*Attorney, Agent, or Firm*—Sprung Horn Kramer & Woods

[57] ABSTRACT

Coater for coating a material web, in particlular a paper web, guided along a backing roller, with a chamber for receiving the coating material, a doctor blade located where the web leaves the chamber, seen in the direction of travel of the material web, an adjustable overflow plate located at the front end of the chamber and with sealing members arranged in the edge region of the backing roller, covering the edges of the material web, comprising recesses extending in the direction of the web, edge scrapers extending in the direction of travel of the web from in front of the overflow plate to immediately in front of the doctor blade, with a channel and compressed air supply opening in the region of the overflow plate.

10 Claims, 4 Drawing Sheets

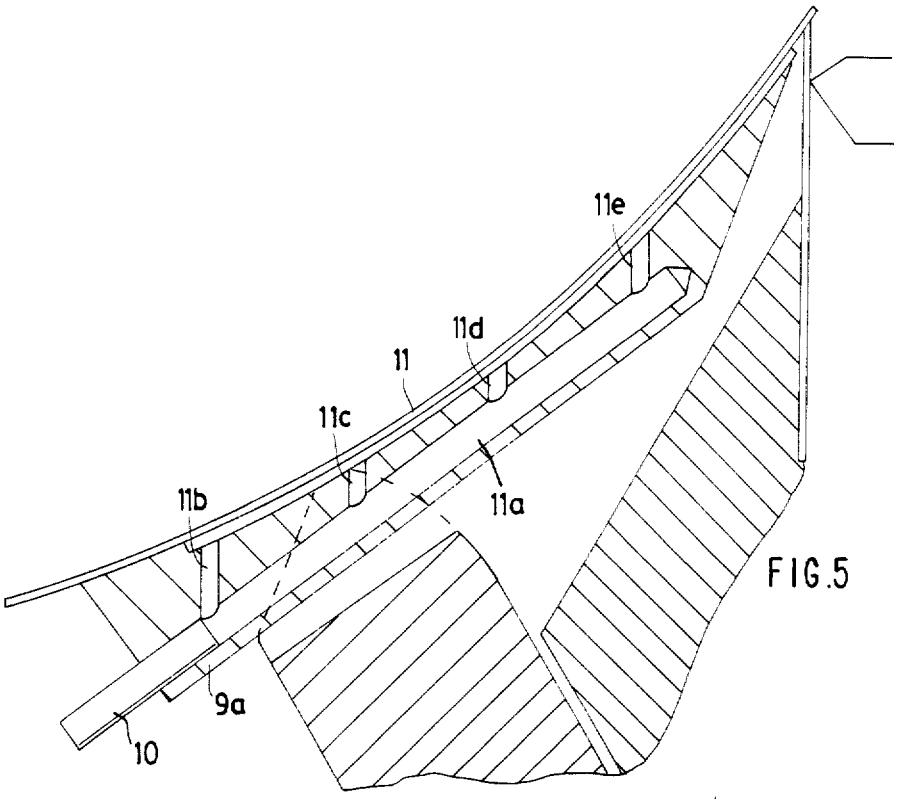
FIG.5
FIG.6
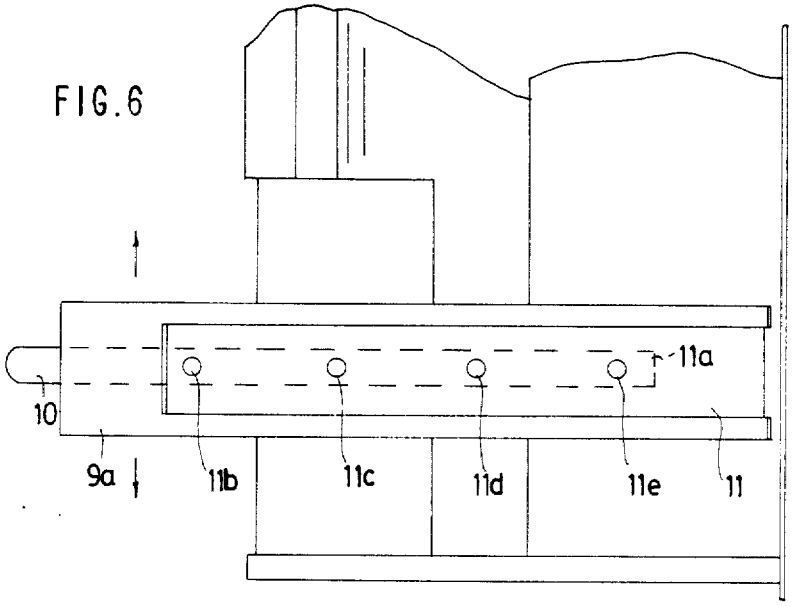

COATER FOR COATING MATERIAL WEBS

This is a continuation-in-part of application Ser. No. 017,190, filed Feb. 20, 1987, now pending.

The invention relates to a coater for coating a material web, in particular a paper web, guided along a backing roller, with a chamber for receiving coating material, a doctor blade located where the web leaves the chamber, an overflow plate located at the front end of the chamber and with sealing members located in the edge region of the material web and thus of the backing roller and comprising recesses extending in the direction of the web (generally circumferentially of the roller as shown in FIG. 1).

A coater of this type is described in German Offenlegungsschrift 3,300,612. In the latter, the chamber is sealed at the end faces of the backing roller by lateral plates overlapping the gap between the backing roller and the base of the chamber and by sealing wedges additionally arranged in the gap, which bear both against the end faces of the rollers as well as on the edge of the paper web. The sealing members consist of an elastomer, which is braced to a greater or lesser extent against the base of the chamber and the backing roller. In the region of the side edges of the material web, a gap corresponding to the thickness of the material web extends. Recesses located in the sealing member serve as a labyrinth seal and allow a small amount of coating material to pass therethrough. This is intentional since the coating material serves for lubricating the surfaces of the sealing member and of the backing roller sliding one on the other. However with the known coater it is not possible to obtain a clean material web edge which is completely free from coating material.

In comparison therewith it is the object of the invention to provide a coater with which it is possible to obtain a cleaner, more uniform edge of the material web and which is completely free of coating material.

This object is achieved due to the fact that the coater of the afore-mentioned type comprises according to the invention a compressed air supply to the recesses in the lateral coating edge limiters or edge scrapers. The air flowing into the recesses at excess pressure prevents lateral penetration of the coating material between the edge scraper and the material web, since the boundary layer of air located on the paper surface and assisted by the compressed air supplied covers the edge of the web in the critical region directly at the doctor blade with respect to the coating material. Air possibly entering the chamber is discharged without problems through the gap at the overflow plate.

The compressed air supply advantageously comprises a pressure adjusting valve, in order to be able to adapt the pressure to the respective requirements. The compressed air supplied may possibly be moistened with water for the protection of the doctor blade and for the self-cleaning of the edge scraper.

Preferably the coating edge limiter consists of an edge scraper extending in the direction of travel of the web from in front of the overflow plate to directly in front of the doctor blade and with a channel beginning in the region in front of the overflow plate.

The edge of the edge scraper facing the backing roller should be curved to correspond to the radius of the backing roller and preferably consists of a flexible or resilient material or is coated with such. After a short initial stage, the edge scraper operates virtually without contact, so that only slight wear of the edge scraper and of the backing roller occurs. In this case, a variation of the operating angle and of the linear force of the doctor blade has no affect on the function of the edge scraper.

In the region of the overflow plate, the edge scraper is advantageously higher and is located in a recess in the overflow plate. At this point it comprises a tubular connection. The channel in the edge scraper preferably tapers and stops in the region of the doctor blade.

BRIEF DESCRIPTION OF THE DRAWINGS

The invention will be described in detail hereafter with reference to an embodiment illustrated in the drawings, in which:

FIG. 5 is a section through a modified coater in accordance with the invention; and FIG. 6 is a plan view of the edge scraper of FIG. 5.

Figure 1:
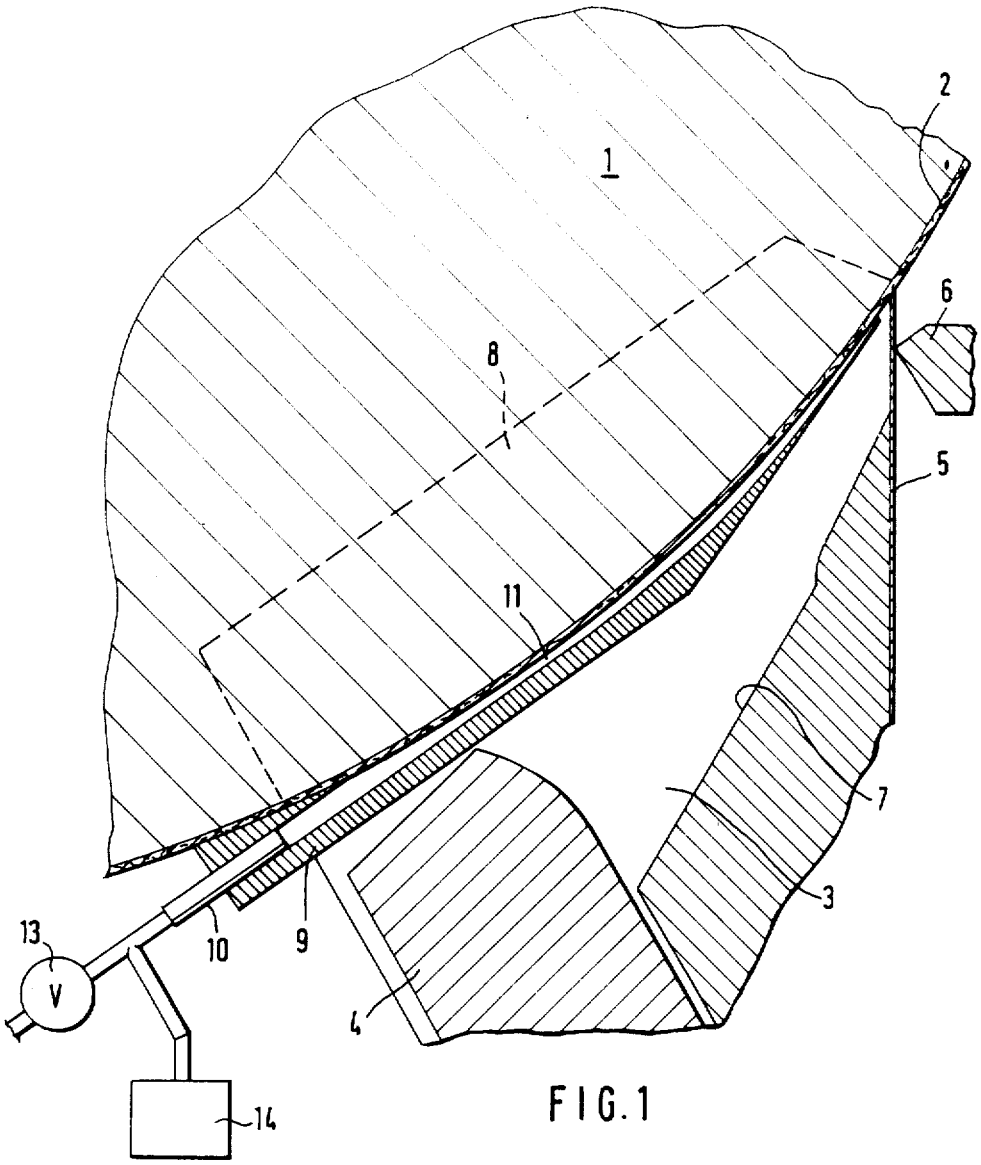
FIG. 1 is a section through a coater limited to the region which is essential to the invention.
Figure 2:
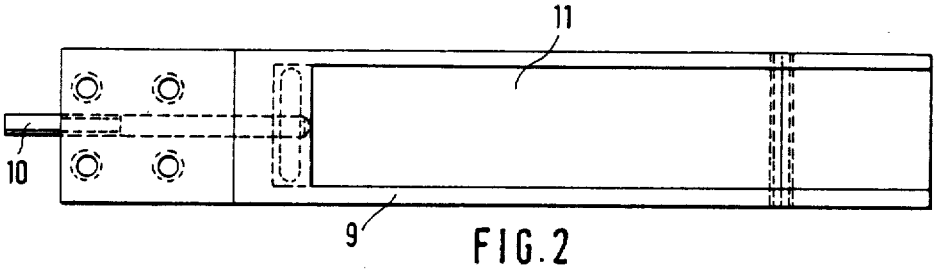
FIG. 2 is a plan view of the edge scraper according to the invention.
Figure 3:
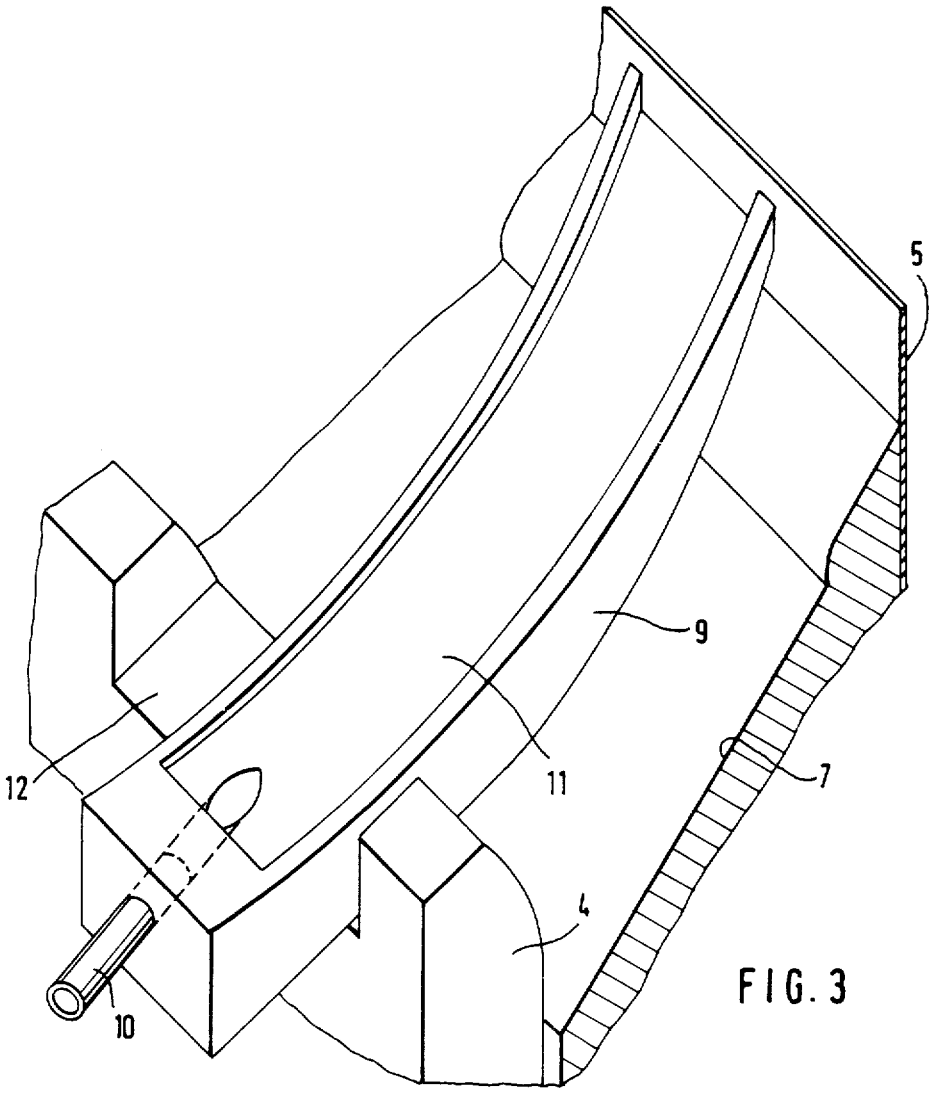
FIG. 3 is a perspective view of the edge scraper in the coater.
Figure 4:
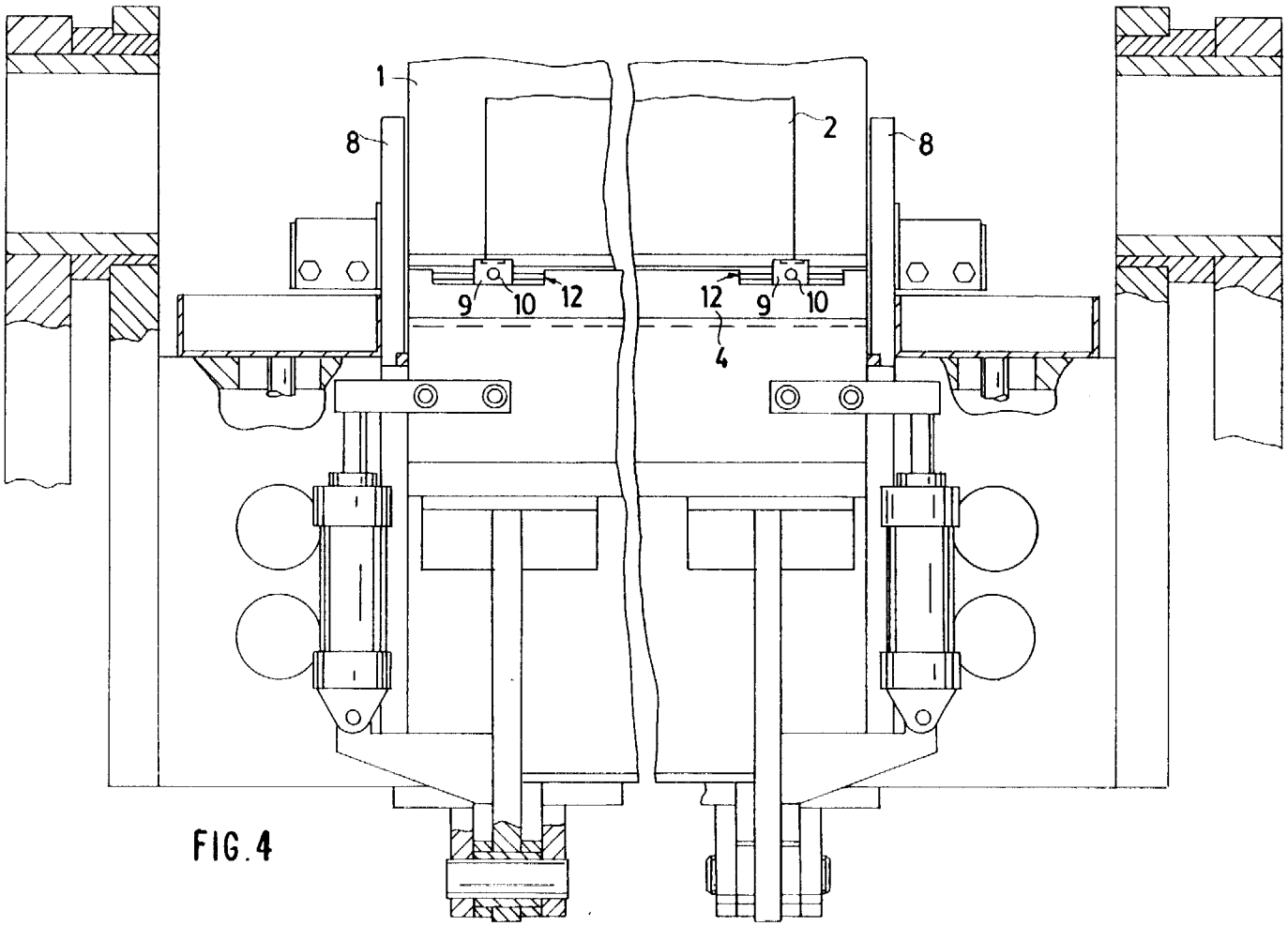
FIG. 4 is a view of the coater showing the front or paper-intake.

Details of a coater are given in German Offenlegungsschrift 3,300,612. Therefore, hereafter, only the parts of such a coater relating to the invention will be described.

Located between a backing roller 1, over which a paper web 2 is guided, an overflow plate 4, a doctor blade 5 and a chamber base 7 is a chamber 3, to which the coating material is supplied. The doctor blade 5 is supported on a comb bar 6. The lateral openings in the chamber 3 in the region of the end faces of the backing roller 1 are closed on both sides by insulating (backing) plates 8.

Located in the edge region of the backing roller 1 are coating edge limiters in the form of edge scrapers 9, which extend from in front of the overflow plate 4 through the chamber 3 as far as the doctor blade 5. Located in each edge scraper 9 is a recess in the form of a channel 11, which begins in the region of a thickened end of the edge scraper 9 and stops immediately before the doctor blade 5. A tubular connection 10 for compressed air is located in the region of the thickened end of the edge scraper 9.

Located on each side of the overflow plate 4 is a recess 12, in which an edge scraper 9 is respectively located. Each edge scraper overlaps an edge region of the material web 2.

The compressed air supplied through the tubular connection 10 forms an air cushion in the channel 11, which cushion reliably prevents lateral penetration of the coating material between the edge scraper 9 and the paper web 2. The air emerging laterally from the channel 11 and passing into the chamber 3 escapes through the overflow gap located between the overflow plate 4 and the backing roller 1. Thus the edges of web 2 are kept free of the coating material.

It has been found that when the coating chamber has a wetting section, i.e. the space between the overflow strip and the flow-metering device, in excess of about 50 mm, there are problems with the cushion of air. This is dealt with in FIGS. 5 and 6 wherein the edge scraper 9*a* is somewhat thicker to accommodate channels 11*a* to 11*e* which extend between connection 10 and channel 11. Channels 11*b, c, d* and *e* are less than 50 mm from one another, thereby ensuring enough excess pressure in channel 11 along the overall wetting section to retain the liquid coating and keep the edge free of it.

The structures of the present invention function as an edge doctor or coating-edge limiter rather than as a seal per se, although all of these effects can be realized simultaneously.

What is claimed is:

1. In a coater for coating a material web, such as a paper web, including a backing roller for the web, a chamber for receiving coating material, a doctor blade disposed where the web leaves the chamber, and an overflow plate located at the front end of the chamber, the improvement which comprises a coating edge limiting means disposed in the chamber and located at an edge of the web and including recesses extending generally circumferentially of the roller and facing the roller, a means for supplying compressed air to the recesses, whereby the coating material is kept away from an edge of said web by the compressed air, and insulating plates laterally sealing the chamber.

2. A coater according to claim 1 including a pressure adjusting valve for the compressed air supply.

3. A coater according to claim 1 including a humidifier for the compressed air supply.

4. A coater according to claim 1, wherein the edge scraper is adjustable.

5. A coater according to claim 1, wherein the coating edge limiting means comprises an edge scraper extending in the direction of travel of the web from in front of the overflow plate to directly in front of the doctor blade, and a channel beginning in the region in front of the overflow plate.

6. A coater according to claim 5, wherein an edge of the edge scraper facing the backing roller is curved to correspond to the radius of the backing roller.

7. A coater according to claim 6, wherein the edge of the edge scraper comprises at least partly a resilient material.

8. A coater according to claim 5, wherein the edge scraper is thicker in the radial direction of the roller in the region of the overflow plate and is disposed in a recess in the overflow plate and is attached to a tubular connection.

9. A coater according to claim 8, wherein the channel in the edge-scraper tapers and ends in the region of the doctor blade.

10. A coater according to claim 8, wherein the scraper includes first and second channels and at least one third channel, the first and second channels extending generally in the circumferential direction of the roller, the third channels connecting the first and second channels so that there is no more than 50 mm distance between third channels, the first channel facing the backing roller and the second channel communicating with the tubular connection.

* * * * *